United States Patent [19]

Butas, Jr.

[11] 3,974,867

[45] Aug. 17, 1976

[54] LOG SPLITTER

[76] Inventor: Joseph T. Butas, Jr., 8102 Theota Drive, Parma, Ohio 44129

[22] Filed: Apr. 30, 1975

[21] Appl. No.: 573,018

[52] U.S. Cl. ..... 144/193 A; 144/193 E

[51] Int. Cl.[2] ..... B27L 7/00

[58] Field of Search..... 144/182, 184, 192, 193 R, 144/193 A–193 K, 194, 195, 3 K, 253 C, 287, 309 R

[56] References Cited

UNITED STATES PATENTS

| | | | |
|---|---|---|---|
| 873,418 | 12/1907 | Eckenroth | 144/193 A |
| 995,833 | 6/1911 | Wood | 144/253 C X |
| 2,612,916 | 10/1952 | Bailey | 144/194 |
| 3,319,675 | 5/1967 | Bles | 144/193 A |
| 3,596,691 | 8/1971 | Broadfoot | 144/193 A |
| 3,862,651 | 1/1975 | Heikkinen | 144/193 A X |

FOREIGN PATENTS OR APPLICATIONS

| | | | |
|---|---|---|---|
| 33,360 | 1/1885 | Germany | 144/193 H |
| 603,135 | 6/1948 | United Kingdom | 144/193 D |

*Primary Examiner*—Al Lawrence Smith
*Assistant Examiner*—Gary L. Smith
*Attorney, Agent, or Firm*—Ronald R. Stanley

[57] ABSTRACT

A log splitter for use in a high production environment utilizes a four-way, stepped knife blade at either end of a longitudinal stroke. A log is automatically placed and positioned between and at the center of the four-way knife blades by a hydraulically operated table. A self centering circular ram connected to a two-way hydraulic cylinder forces the log through either of the four-way knife blades depending upon which end of the stroke the ram was last positioned. The invention contemplates a conveyor input of logs and conveyor output of quartered logs.

12 Claims, 7 Drawing Figures

LOG SPLITTER

BACKGROUND OF THE INVENTION

1. Field of the Invention

This invention relates generally to the splitting of logs and, more particularly, to an apparatus for, method of and system for the automation of log splitting.

The invention contemplates utilization in a high speed, quantity production system of splitting logs for purposes such as firewood. Although the principles of the invention are generally applicable to the splitting of logs at any step in the development of an automated system, the primary advantage to this invention, i.e., speed, is best utilized in a large quantity output situation.

2. Prior Art

There exists a large number of patents which have been issued for log splitting devices of varying designs. Surely, there have been multitudes of designs for log splitters which have reached the public domain without benefit of patent protection.

One of the earliest designs of patented log splitters, issuing around 1907, was typified by an axe-head moving against a support, between the two of which a log is positioned. The log is held in place by means of guide rods at either side of the log. The axe-head is also slideably mounted on the guide rods. U.S. Pat. Nos. 846,838 and 846,839 are concerned with a design such as this.

In 1908, U.S. Pat. No. 885,458 issued on a design basically the same as those immediately above, but with the axe-head stationary and the log support moveably mounted on guide rods.

In all of the patents cited above, the dimensions of the log are extremely important. The diameter is strictly limited on the one hand by the distance between the guide rods and on the other hand by the inability to center a log which is too small.

Further, all of the above patents teach the use of an axe-head blade for cutting the log. This axe-head construction results in a massive wedge-like structure which is required either to be pushed through a log or to have a log pushed through it. Clearly, the force required to do this is great. The design of the above mechanisms are such that the log is not really split, but rather only perforated at one end in hope that the pressure of the hydraulic cylinder will cause the log to crack into portions.

Yet another concept is shown by U.S. Pat. No. 3,596,691, which has a specifically stated purpose of making fencing material. This apparatus has a cutting blade which is forced through a log by chain drive system. The apparatus also includes an elaborate mechanism for causing the log to rotate in order to allow splitting of the log along any diameter. Still further, a mechanism is included to hold the split log together, while turning and splitting at another diameter.

Two other patents, U.S. Pat. Nos. 3,077,214 and 3,280,864, concern a stationary blade with an hydraulically operated log pusher. The former patent includes its own hydraulic pump motor while the later patent contemplates operation in conjunction with an independent pump means, such as a tractor. These apparatus are, of course, limited to the size of log which they will accommodate, although not as exacting as the patents above mentioned. Also, the cutting blade in both of the apparatus are substantially bulky requiring large amounts of hydraulic force as noted with respect to previously mentioned concepts. One further comment is that each log must be hand placed between the blade and the pusher. Also, after splitting, the logs, have fallen from the machine must again be handled manually.

A number of issued patents suggest the use of a four-way blade to simultaneously split a log into four portions. Two examples of this approach are shown by U.S. Pat. Nos. 885,458 and 889,328. The former was discussed above with respect to the basic details. The latter involves a blade slideably mounted on guide rods and mechanically forced against a log in the direction of a fixed support. In both cases, the four-way blade is a massive structure requiring much brute force to even begin to split the log. Even the fact that the former patent mentions the four-way blade only in passing indicates the nonimportance and ineffectiveness of the idea as viewed by the inventor.

In U.S. Pat. No. 2,580,735 a four-way blade is shown which is intended to be forced through a log by a combination of hydraulics and mechanics. The log must, however, be manually loaded and unloaded from the apparatus. The blade is intended to split a log into four portions during the first half of a stroke and return the blade to a start position on the second half of the stroke.

An even more recent concept utilized in the prior art is shown by U.S. Pat. No. 3,319,675. In this apparatus, a double sided blade is used to enable logs to be split as the blade moves in both directions. The blade is attached to a slide and activated by a two-way hydraulic cylinder. Abutments at either end of the slide restrain logs during splitting. The logs must be manually loaded into the splitter and manually maneuvered to either again split the sections or remove the sections upon completion of splitting.

The prior art appears to show no concern for automating the log splitting processes to effect an economic, quantity operation.

SUMMARY OF THE INVENTION

The primary object of this invention is to provide an apparatus for, a method of and a system for the splitting of logs which is economic, safe, quick and easy to operate.

Other objects of this invention are to provide a new and improved log splitter which operates by hydraulics, which splits a log into four sections, which splits a log during each stroke of a two-way hydraulic cylinder, i.e., extension and return, and which is adjustable for the size of the log to be split.

Still other objects of this invention are to provide a new and improved log splitter system which is automatically loaded with logs individually, which is automatically orientated to accept and split a log at either end of the stroke of a two-way hydraulic cylinder, and which automatically transports the split logs away from the splitter.

Still another object of this invention is to provide a new and improved log splitter which includes a four-way knife edge blade for splitting logs which operates in four stages to assist in holding the log while splitting and reducing the amount of force necessary to split a log.

Yet another object of this invention is to provide a new and improved log splitter and system of splitting logs which is profitable for both the business of splitting logs for firewood or any other reason and the business of ultimately selling the product of such a system.

A still further object of this invention is to provide a new and improved log splitter which obtains one or more of the objects and advantages set forth above.

These and other objects and advantages of this invention will become apparent from the following description thereof, in view of the accompanying drawings.

DETAILED DESCRIPTION OF THE PREFERRED EMBODIMENT

The invention described herein is concerned with an apparatus for splitting logs. The invention is further concerned with a method of splitting logs and an automated system of splitting logs. The single most beneficial feature of the invention is the increase in speed of operation which is possible through the use of this invention. The log splitter of this invention is designed primarily with a view towards a high production system including conveyor input and conveyor output. Since the logs are to be split through the use of hydraulics, a hydraulic pump is, of course, necessary. As in the case of many of the prior art concepts, a tractor having a hydraulic system may be utilized for the pump in this case. On the other hand, an independent pump may be provided for the operation of the splitter.

Figure 1:
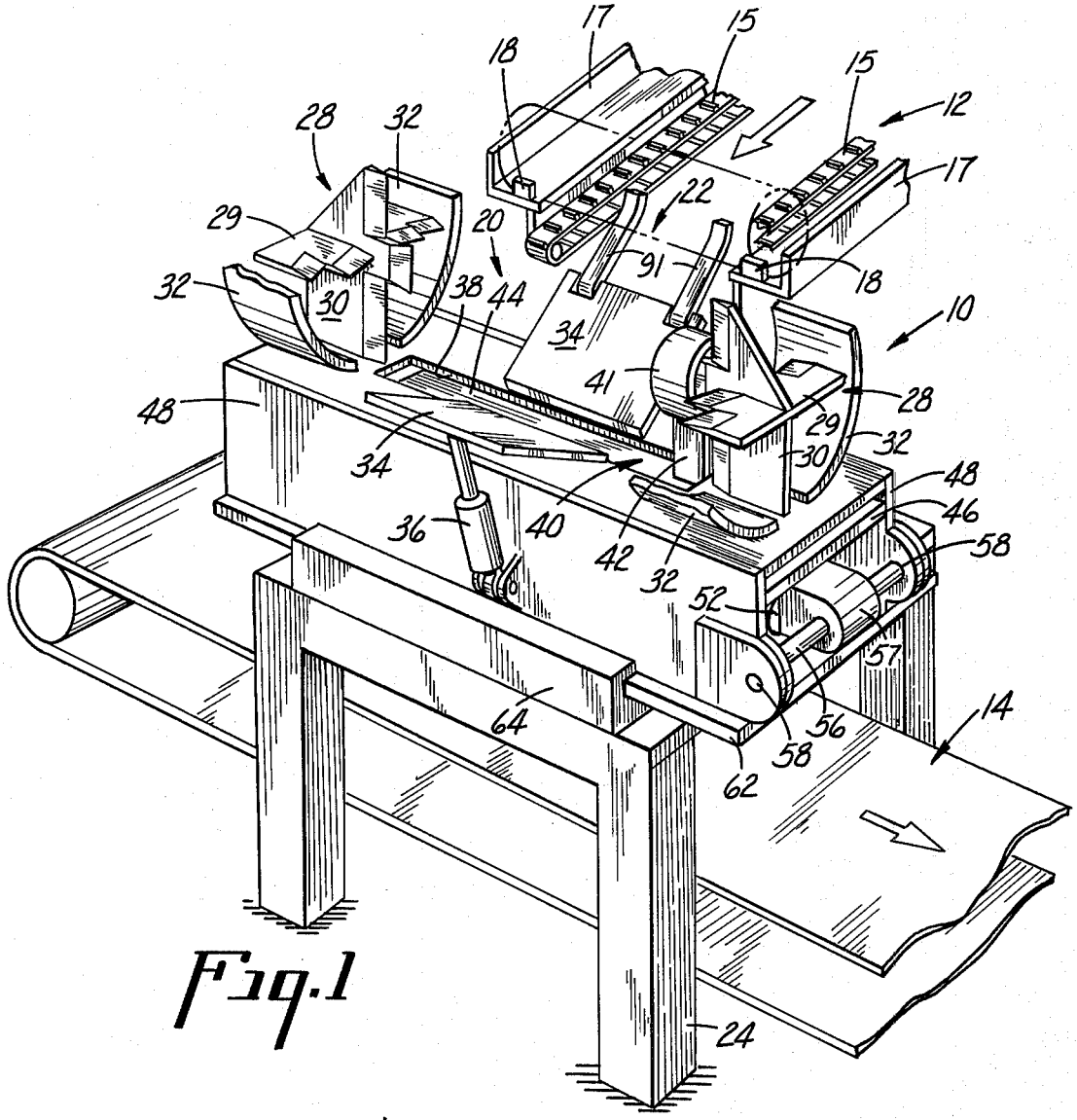
FIG. 1 is a perspective view, partially broken away, illustrating a system including the log splitter of this invention.

FIG. 1 illustrates a log splitter, indicated generally at 10, of this invention having an input conveyor 12 and an output conveyor 14 associated therewith. The input conveyor 12 comprises two continuous driven chains 15 alignment supports 17 and stops 18. The continuous chains 15 are driven by means (not shown in the figures) to effect movement of logs from a source into abutting relationship with the stops 18, one after another, between the aligning supports 17.

Logs, from the input conveyor 12, are individually positioned onto an adjustable table, indicated generally at 20, by means of a self-loading mechanism, indicated generally at 22 and more fully described at a subsequent portion of this disclosure. The adjustable table 20 is designed to enable proper positioning of a log within the splitter 10.

The log splitter 10 is supported by a frame 24 in a manner allowing the output conveyor 14 to carry the split logs away from the system. The adjustable table 20 is supported in turn on a base structure 26 which is an integral part of the log splitter 10. Spaced equidistant at either end of the adjustable table 20 is a four-way blade, indicated generally at 28. The four-way blades 28 each include a horizontal 29 and vertical 30 blade.

The particularities and design of the four-way blades 28 is more fully explained at a subsequent portion of this disclosure. Each of the four-way blades 28 is partially surrounded by a guide 32 which is intended to restrain the split log from movement in any undesired direction. It is not necessary that the guide 32 completely encircle the four-way blades 28 but only that the guide 32 extend above the horizontal blade 29 a sufficient distance to restrain positions of the log above the horizontal blade 29.

The adjustable table 20 comprises two separate wings 34, one edge of each of which is attached to the base structure 26 by means of hinges (not shown in FIG. 1) or other suitable pivoting means. The other side of each of the wings 34 is supported by hydraulic cylinders 36, an explanation of which will follow subsequently. Between the hinged ends of the wings 34 is a slot 38 in the base structure 26 which extends the longitudinal distance between the four-way blades 28.

Through the slot 38, extends a ram indicated generally at 40. The ram 40 includes a hollow cylindrical pusher 41 with a bar extension 42 permanently attached thereto and extending down through the slot 38. The pusher 41 is of a diameter to be compatible with the diameter of any size of log to be split by the invention. In this respect, the pusher 41 contacts the cross-section of a log to be split at a more or less continuous ring at a given radius, i.e., the radius of the pusher, rather than only at a single point. Thus the pusher 41 assists in centering, holding, and stabilizing the log while in the process of splitting the same.

Figure 2:
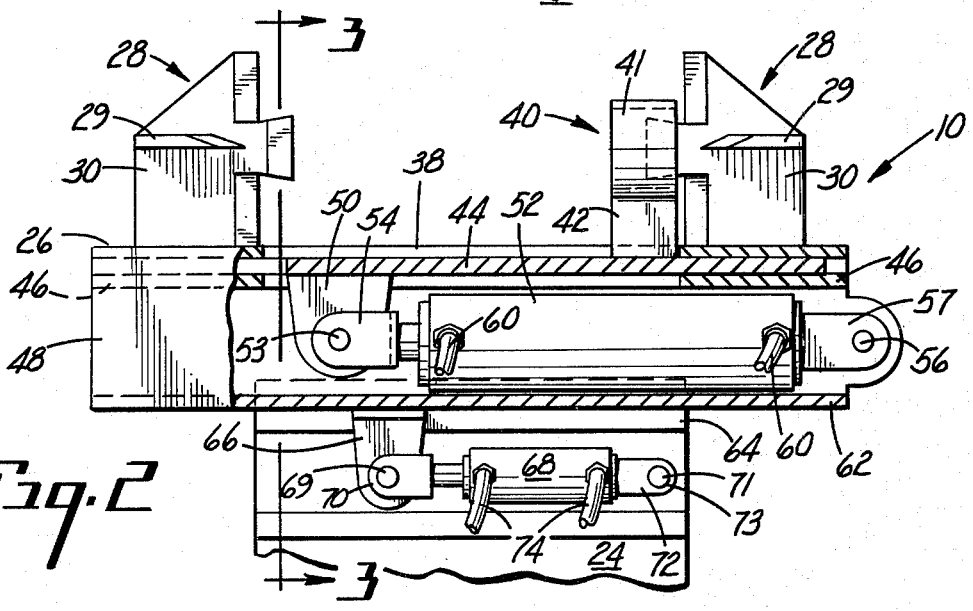
FIG. 2 is a cross-sectional view of the log splitter of FIG. 1.
Figure 3:
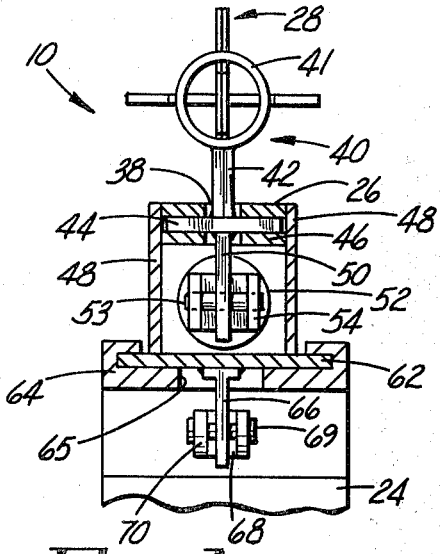
FIG. 3 is a cross-sectional view of the log splitter taken along the line 3—3 of FIG. 2.

FIGS. 2 and 3 are of considerable help in explaining the design and working of the log splitter 10 and particularly the ram 40. The bar extension 42 of the ram 40 extends through the slot 38, as noted above, and is permanently attached to the top surface of a slide plate 44, which is positioned between the base structure 26 and a guide plate 46. The base structure 26 and guide plate 46 are both permanently fixed in position by being attached to side plates 48.

The upper surface of guide plate 46, lower surface of base structure 26 and both surfaces of slide plate 44 are smoothly machined and thus the slide plate 44 is capable of easily sliding within and between the base structure and guide plate. The bar extension 42 is attached to the slide plate 44 in such a position that when the slide plate moves to either extreme within the log splitter 10, the ram 40 is moved within the slot 38 between the four-way blades 28.

A bracket 40 is permanently attached to the bottom surface of the slide plate 44. To this bracket 50 is attached the piston of a hydraulic cylinder 52 by means of a pin 53 fastened through the bracket 50 and a connector 54 on the piston of the hydraulic cylinder 52. The opposite end of the hydraulic cylinder 52 is permanently fixed to a portion of the log splitter 10, such as the side plates 48 by means of a pin 56 fastened through a bracket 57 on the cylinder 52 and openings 58 in the side plates 48. In this manner, the hydraulic cylinder 52 is fixed in position, with respect to the log splitter 10, however the piston of the cylinder and thus the ram 40 are able to be moved.

The hydraulic cylinder 52 has two hydraulic lines 60 connected thereto for the purpose of moving hydraulic fluid in and out of the cylinder upon the application of appropriate control signals. The principles of the hydraulic lines 60 and control mechanisms for the hydraulic cylinder 52 are well known in the art and will therefore only be cursorily explained in this disclosure.

The side plates 48 are permanently connected at their respective bottom edges to a second slide plate 62. This second slide plate 62 is journalled or otherwise rendered slidable within a base structure 64. Both surfaces of the second slide plate 62 and the inside surfaces of the base structure 64 are smoothly machined in order to allow relative movement between the two.

The bottom surface of the base structure 64 has an elongated aperture 65 therethrough (FIG. 3) and a bracket 66 which extends upwards through the aperture 65 and is permanently attached to the second slide plate 62. To the bracket 66 is attached the piston of a hydraulic cylinder 68 by means of a pin 69 fastened through the bracket 66 and a connector 70 on the piston of the hydraulic cylinder 68.

The other end of the hydraulic cylinder 68 is permanently attached to a fixed structure such as the frame 24 by means of a pin 71 fastened to a bracket 72 on the cylinder 68 and appropriate openings 73 in the frame 24. The purpose of hydraulic cylinder 68 is to enable movement of the entire log splitter 10 relative to the frame 24 for reasons that will be more fully developed subsequently with respect to the operation of the log splitter.

The hydraulic cylinder 68 has two hydraulic lines 74 connected thereto for the purpose of moving hydraulic fluid in and out of the cylinder upon the application of appropriate control signals. Once again the principles of hydraulic systems in general is known in the art and assumed to be understood herein.

Figure 4:
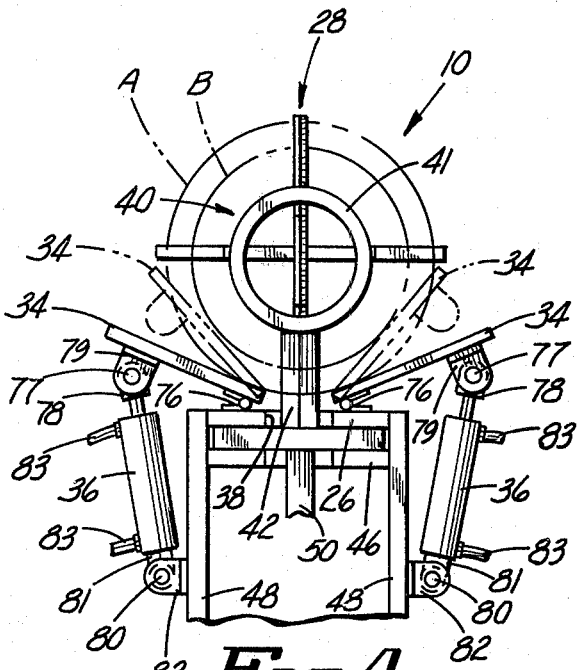
FIG. 4 is a partial cross-sectional view of the log splitter illustrating the adjustable table.

FIG. 4 illustrates the design and function of the adjustable table 20. As noted above, one edge of each wing 34 is attached to the base structure 26, immediately adjacent to the slot 38, by means of hinges 76, or any other suitable means. Also as noted above, the other edge of each wing 34 is supported by means of hydraulic cylinder 36. The piston of each cylinder 36 is attached to each wing 34 by means of a pin 77 fastened through a connector 78 on each piston of the cylinders 34 and a bracket 79 permanently attached to each wing 34.

The other end of each hydraulic cylinder 36 is attached to the respective side plate 48 of the log splitter 10 by means of a pin 80 fastened through a connector 81 integral with the cylinder 36 and a bracket 82 permanently attached to the side plates 48. The hydraulic cylinders 36 have two hydraulic lines 83, each, connecting them to the controls and hydraulic pump for the purpose of causing hydraulic fluid to move in and out at appropriate times in order to raise or lower the wings 34.

FIG. 4 illustrates the positioning of the wings 34 necessary to accommodate logs of differing diameters. The wings 34 and associated portions shown in solid lines indicate the position required for a log having a size such as log A. The wings 34 shown in phantom lines indicate the different position required for a log having a size such as log B. It may easily be seen that the primary purpose of the wings 34 is to position a log so that the center of the log is at the center of the four-way blades 28. Thus the wings 34 are raised or lowered, as required, to position each log at the center of the blades as it enters so that the split portions will be substantially equal.

Figure 5:
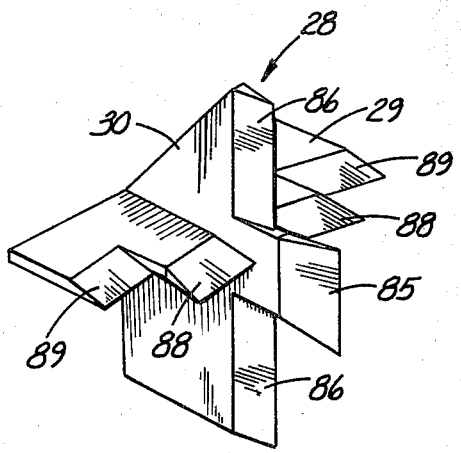
FIG. 5 is a perspective view of one of the knife edge four-way blades of this invention.

FIG. 5 illustrates the details of the four-way blades 28 utilized to split the logs into four equal portions. As stated above, there is included the horizontal blade 29 and the vertical blade 30. The vertical blade 30 is designed to contact a log first. The center of the vertical blade 30 includes a leading knife 85 which contacts a log even before the remainder of the vertical blade, i.e., vertical edge 86. The vertical blade 30 is not of a massive width, but rather only thick enough to resist bending upon the pressure of a log. Knife edges are machined at the appropriate places on the blade 30.

The horizontal blade 29 while being arranged to control a log after both the leading knife 85 and vertical edge 86 of blade 30, also has a leading edge 88 which contacts a log before the remainder of the horizontal blade 29, i.e., horizontal edge 89. Both the leading knife 88 and the horizontal edge 89 of blade 29 are constructed so that their respective inner most edges contact a log after the outer most edges. The reason for this design is to assure that the log not move or slip while splitting is taking place. In this respect, the outer most radius of a log is held in position as opposed to the center of the log.

The construction of blade 29 is similar to that of blade 30 with respect to the total thickness of the blade and the machining of the knife edges.

Figure 7:
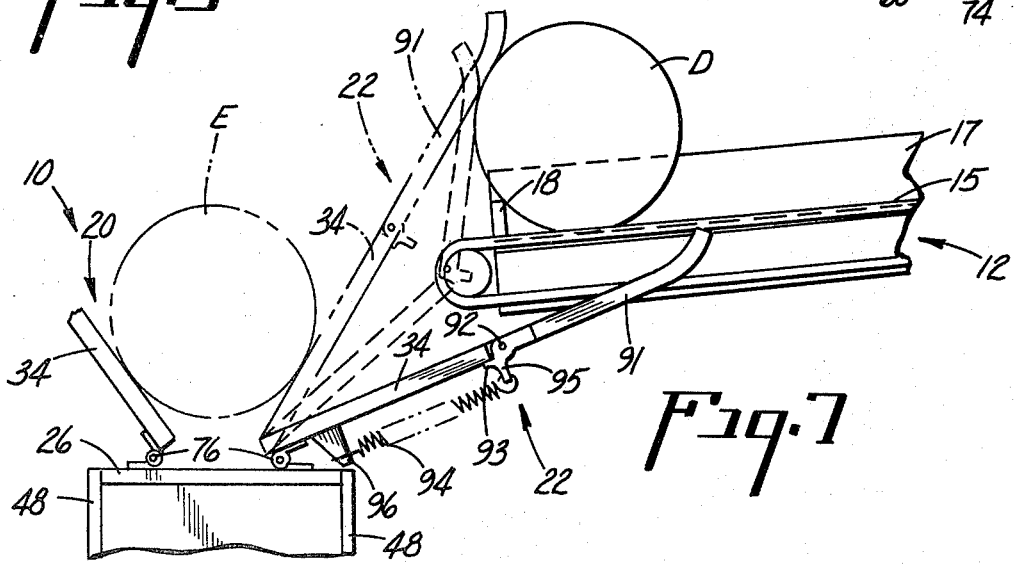
FIG. 7 is a partial, cross-sectional view of the log splitter illustrating the self-loading feature of the invention.

FIG. 7 may be utilized to describe the construction and function of the self-loading mechanism 22 referred to above. The one wing 34 adjacent to the input conveyor 12 includes two fingers 91 (shown in FIG. 1) which are hingedly attached to the wing 34 by any suitable means, such as a pin 92. The fingers 91 include a stop 93 which serves to assure that the fingers 91 only bend as far as to be in line with the wing 34.

The fingers 91 are spring loaded to be in line with the wing 34 and for this reason springs 94 are attached to the fingers 91. One end of each spring 94 is attached to a bracket 95 on each finger 91 and the other end of the spring 94 is attached to a bracket 96 on the wing 34.

FIG. 7 shows a log D positioned on the input conveyor 12 and adjacent to the stop 18. Another log E is shown positioned on the adjustable table 20. Once the log E has begun to be split by the log splitter 10, the adjustable table 20 may be operated to lower the wings 34 in order to be able to accept the next log. As the wings 34 are lowered, the fingers 91 strike the log D and begin to fold upward at the pin 92. As viewed in FIG. 1, the fingers 91 are positioned so that they do not interfere with the chains 15 of the input conveyor 12.

As the wings 34 of the adjustable table 20 continue to move downward, the fingers 91 bend or pivot about pin 92 until they are clear of the log D. Once clear of the log D, the fingers 92 are immediately returned to being in alignment with the wing 34 by reason of the tension on springs 94. At this point, the fingers 91 are ready to pick another log up from the input conveyor 12 and into the log splitter 10. The operation of the log splitter 10 will be fully described below.

Figure 6:
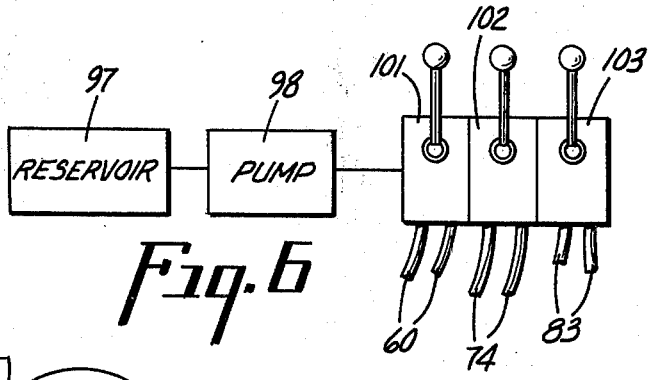
FIG. 6 is a schematic illustrating the controls and hydraulics necessary for operation of this invention.

FIG. 6 illustrates, in partial schematic, the control of the log splitter 10. A reservoir 97 for hydraulic fluid is provided. The reservoir 97 may be an independent unit attached to the log splitter 10 as necessary, or it may comprise the frame 24 of the log splitter 10 with appropriate connections.

A hydraulic pump 98 is also provided. The hydraulic pump 98 may be an independent unit or, as in the case of many prior art splitters, the pump 98 may be provided by a tractor conveniently positioned relative to the log splitter 10. Appropriate hydraulic connections are present between the reservoir 97 and the pump 98.

Finally, a bank of hydraulic switches, three in this case 101, 102 and 103, are utilized to control the splitter 10. The switches 101, 102 and 103 are connected by appropriate hydraulic lines to the reservoir 97 and pump 98. The switch 101 controls the hydraulic cylinder 52 which operates the ram 40 as described above. For this reason, switch 101 has connected thereto the hydraulic lines 60.

The switch 102 controls the hydraulic cylinder 68 which operates the movement of the splitter 10 relative to the frame 24 as described above. The switch 102 has connected thereto the hydraulic lines 74 for this purpose.

The switch 103 controls the hydraulic cylinders 36 which operate the wings 34 of the adjustable table 20. For this purpose, the switch 103 has hydraulic lines 83 connected thereto which at some point (not shown) have a Y-connection so that both cylinders 36 may be operated.

The operation of the log splitter will be explained in view of all of the above portions which have been discussed. Once the pump 98, input conveyor 12 and output conveyor 14 are operating, logs may be loaded into the conveyor 12. The logs will be moved along the conveyor 12 until they reach the stops 18 at which point they will rest (with the conveyor moving thereunder). The fingers 91 of the adjustable table 20 should be beneath the logs on the conveyor 12. In the event that they are not, the switch 103 is operated to so position the fingers 91.

The first log on the conveyor 12 is loaded into the splitter 10 by operating the switch 103 so that the wings 34 are raised. As soon as the fingers 91 raise the log enough to clear the stops 18, the log moves down the fingers 91 to rest against both wings 34. The adjustable table 20 may then be operated by switch 103 to position the center of the log at the center of the four-way blades 28.

The log at this time is positioned between one of the four-way blades 28 and the ram 40. The ram 40 is then operated, by means of switch 101, to cause the pusher 41 to engage the log and begin forcing the log through one of the four-way blades 28. The operation of the blade 28 is as noted above. As the log is pushed through the blade 28, the guide 32 keeps the portions from falling out of the splitter 10. When the ram 40 has pushed the log completely through the blade 28, the guide 32 assures that the split log falls out either end of the splitter 10 and onto the output conveyor 14. The output conveyor 14 carries the split logs away for further handling, such as stacking.

As soon as the ram 40 has begun pushing the log through the blade 28, the adjustable table is lowered, by operation of switch 103, so that the wings 34 are out of the way and do not interfere with operation. The table 20 is lowered so that the fingers 91 are below the next log on the conveyor 12.

Once the log has been split, the ram 40 is positioned with the vertical leading knife 85 of one blade 28 inside the cylindrical pusher 41. The splitter 10 is now ready for another log. The operation is the same as described above. The switch 103 is operated to load the next log onto the adjustable table 20 and position the log at the center of the blade 28. The switch 101 is operated as before to cause the ram 40 to push the log through the other blade 28.

Thus the two-way hydraulic cylinder 52 causes a log to be pushed through one of the blades 28 at the end of each stroke. The log portions are restrained by the guides 32 in order to be dropped onto the conveyor 14 and carried away.

As may be viewed in FIG. 1, the input conveyor 12 is as wide as the logs are long. The length of each log is preferably the same as the distance between the vertical knife edge 85 of the one blade 28 and the pusher 41 when at the end of its stroke. Since the pusher 41 and ram 40 will be at either one end or the other of its stroke as successive logs are loaded, the logs must be loaded at slightly different positions each stroke. This is the purpose for which the hydraulic cylinder 68, and it associated hardware, are intended.

The entire splitter 10 is moved relative to the frame 24 by operating the switch 102. The splitter 10 need only be moved the thickness of the pusher 41 each time a log is to be loaded.

It may easily be understood that the switches 101, 102 and 103 which operate the splitter 10 may be either manually operated or automatically controlled. Limit switches and other control circuitry (not shown) may be provided to render the operation of the splitter 10 automatic and thus attended operation unnecessary.

As explained above, the primary benefit expected to be achieved through the use of this invention is the speed of splitting logs. Consequently, depending upon the size of logs (diameter), the splitter could be utilized as the missing link in an overall high production system. In this regard, a first log splitter could be arranged to split logs having diameters of from 36 inches to 15 inches. The split logs from the first splitter could then be directed to a second splitter which would handle logs having diameters from 15 inches on down. In the event that the initial logs were under 15 inches in diameter, they would not be sent through the first log splitter.

In any case, a log with a diameter less the one half the height of the blades 28 could be split in two by allowing the adjustable table 22 to lower the whole log below the horizontal blade 29 of the four-way blade 28. In this manner, the log would be split only in two by the vertical blade 30.

Some additional parameters for the log splitter 10 are first that the logs may be 18 to 20 inches in total length. The time required to split a log is anywhere from 4 to 8 seconds depending, of course, upon the particularities of the hydraulics involved. In a unit which was actually built and operated, a 45 gallon hydraulic fluid pump and reservoir were utilized. It was found that a four cylinder diesel engine, as might be used in a tractor, was adequate and proficient for operating the hydraulic cylinders necessary for the log splitter 10.

Modifications, changes and improvements to the preferred forms of the invention herein disclosed, described and illustrated may occur to those skilled in the art who come to understand the principles and precepts thereof. Accordingly, the scope of the patent to be issued hereon should not be limited to the particular embodiments of the invention set forth herein, but rather should be limited by the advance by which the invention has promoted the art.

What is claimed is:

1. A log splitter comprising a frame member having a boxlike construction with an elongated aperture in the top thereof, a pair of blade means one permanently positioned at each end of said frame member, adjustable table means positioned between said pair of blade means and supported on said frame member selectably supporting a log relative to the pair of blade means, ram means slidably mounted within said elongated aperture of said frame member, and hydraulic cylinder means attached to said ram means to drive said ram means against one said blade means under expansion conditions and against the other said blade means under contraction conditions.

2. The log splitter according to claim 1 wherein the frame member is slidably mounted on a second frame member and a second hydraulic cylinder means is arranged to move the frame member along a distance upon expansion and contraction.

3. The log splitter according to claim 1 wherein the pair of blade means further comprise horizontal and vertical components whereby a log is split into four individual sections.

4. The log splitter according to claim 3 wherein each of the horizontal and vertical components include a portion thereof removed from and ahead of the remainder of the respective component.

5. The log splitter according to claim 1 wherein the adjustable table means comprises a pair of wing means, one edge of each said pair of wing means being hingedly connected to said frame member adjacent to said elongated aperture and the other edge of each said pair of wing means having a hydraulic cylinder means permanently positioned between the wing means and the frame member whereby the pair of wing means may be selectively positioned relative to the frame member.

6. The log splitter according to claim 5 wherein the said adjustable table includes a self-loading log means integral therewith.

7. The log splitter according to claim 1 wherein the ram means includes a hollow cylindrical pusher for contacting the cross section of a log at a plurality of points to thereby be self balancing.

8. The log splitter according to claim 1 wherein said hydraulic cylinder means is attached to said ram means by a linkage means extending through the elongated aperture in said frame member.

9. A log splitter comprising a first frame member having a box-like construction, said first frame member having an elongated aperture therein, said first frame member slidably mounted on a second frame member, a first four-way blade means mounted at one end of said first frame member and said elongated aperture, a second four-way blade means mounted at another end of said first frame member and said elongated aperture most remote from said first four-way blade means and generally parallel to said first four-way blade means, adjustable table means positioned between said first and second four-way blade means, said adjustable table means having a pair of wing means hingedly connected to said first frame member one on each side of said elongated aperture, ram means slidably positioned within said elongated aperture and extending to the center of the first and second four-way blade means, first hydraulic cylinder means mounted on said first frame member for selectively positioning the pair of wing means, second hydraulic cylinder means mounted on said first frame member and connected to said ram means for moving said ram means along the elongated aperture between the first and second four-way blade means, and third hydraulic cylinder means mounted on said second frame member for moving said first frame member relative to said second frame member.

10. The log splitter according to claim 9 wherein the adjustable table means includes a pair of finger means spring biased thereon for automatically picking up a log and depositing the same onto the adjustable table means.

11. The method of splitting a log through the use of hydraulics comprising loading a log onto an adjustable table means on a frame member, positioning the log relative to the center of a pair of four-way blade means being arranged one at each end of the frame member, forcing a log through one of the pair of four-way blade means with a ram means by means of hydraulic cylinder means, stopping the ram means immediately adjacent to one of said pair of four-way blade means, and forcing another log through the other of said pair of four-way blade means with the ram means by means of a return stroke of the hydraulic cylinder means.

12. A process for splitting logs including a log splitter, an input conveyor and an output conveyor comprising delivering logs to the log splitter by means of the input conveyor, automatically lifting a log from the input conveyor to the log splitter, positioning the log within the log splitter at the center of a pair of stationary four-way splitting blades one at each end of the log splitter, forcing the log through one of the pair of stationary four-way splitting blades by means of a hydraulic cylinder during the expansion stroke of the hydraulic cylinder, dropping the split log out one end of the log splitter from the one stationary four-way splitting blade onto the output conveyor to be carried away, lifting another log from the input conveyor to the log splitter, positioning the log within the log splitter at the center of the pair of stationary four-way splitting blades, forcing the log through the other of the pair of four-way splitting blades by means of the hydraulic cylinder during the return, contraction stroke of the hydraulic cylinder, and dropping the split log out the other end of the log splitter from the other stationary four-way blade onto the output conveyor to be carried away.

* * * * *